10/15/85 4,547,200

United States Patent [19]

Shinohara et al.

[11] Patent Number: 4,547,200

[45] Date of Patent: Oct. 15, 1985

[54] SLURRY COMPOSITION OF SOLID FUEL

[75] Inventors: Hironobu Shinohara; Kiyonobu Kubota; Yoshinori Yoshida, all of Tokyo, Japan

[73] Assignee: Japan Synthetic Rubber Co., Ltd., Tokyo, Japan

[21] Appl. No.: 664,960

[22] Filed: Oct. 26, 1984

[30] Foreign Application Priority Data

Oct. 31, 1983 [JP] Japan ..... 58-204242
Nov. 2, 1983 [JP] Japan ..... 58-206391

[51] Int. Cl.[4] ..... C10L 1/32
[52] U.S. Cl. ..... 44/51; 44/62
[58] Field of Search ..... 44/51, 62

[56] References Cited

U.S. PATENT DOCUMENTS

| | | | |
|---|---|---|---|
| 4,217,109 | 8/1980 | Siwersson et al. | 44/51 |
| 4,242,098 | 12/1980 | Braun et al. | 44/51 |
| 4,252,540 | 2/1981 | Yamamura et al. | 44/51 |
| 4,276,054 | 6/1981 | Schmolka et al. | 44/51 |
| 4,339,246 | 7/1982 | Yamamura et al. | 44/51 |
| 4,398,919 | 8/1983 | Zakaria | 44/51 |
| 4,440,544 | 4/1984 | Honolke et al. | 44/51 |
| 4,441,888 | 4/1984 | Matt et al. | 44/51 |
| 4,462,808 | 7/1984 | Gross et al. | 44/51 |
| 4,484,929 | 11/1984 | Rutter et al. | 44/51 |

*Primary Examiner*—Y. Harris-Smith
*Attorney, Agent, or Firm*—Oblon, Fisher, Spivak, McClelland & Maier

[57] ABSTRACT

Slurry composition comprising a solid fuel powder, water and a compound having in its molecule a tricyclodecane or tricyclodecene skeleton and a sulfonic acid group attached to the skeleton.

9 Claims, No Drawings

SLURRY COMPOSITION OF SOLID FUEL

This invention relates to a solid fuel slurry composition comprising a specific dispersing agent. More particularly, it relates to an aqueous slurry composition of a solid fuel such as coal, petroleum coke or pitch comprising as a dispersing agent a compound having a tricyclodecane or tricyclodecene skeleton and a sulfonic acid group attached to the skeleton.

Recently, attention has been directed to a solid fuel such as coal, petroleum coke or pitch again, and the utilization thereof has been investigated from various points of view. However, the solid fuel is impossible to transport by pump unlike petroleum. Accordingly, there have been made various attempts of a method of preparing an aqueous slurry by pulverizing the solid fuel and dispersing the pulverized solid fuel in water. However, the pump transportation of an aqueous high solid fuel content slurry is difficult in the present technical level, because the aqueous high solid content slurry has a high viscosity and it has been impossible to obtain an aqueous high solid fuel content slurry having a low viscosity. On the other hand, in the case of an aqueous low solid fuel content slurry, the transportation efficiency decreases with a decrease in the concentration of the solid fuel, and moreover, a dehydration step becomes necessary prior to burning. Therefore, said method is costly and hence not practical.

Particularly, in the case of a system consisting only of petroleum coke and water, particles thereof are often agglomerated and undissolved lumps are formed owing to the hydrophobic property of their surface even if the system is vigorously stirred. Even if a uniform dispersion is formed by a sufficient stirring, agglomeration of particles is shortly caused and a hard sediment layer is formed.

This petroleum coke is a residual coke which has been produced by the additional thermal cracking of asphalt, pitch and the like, which are heavy residues in the rectification of petroleum, at a higher temperature, and the powder thereof is extremely difficult to wet with water as compared with a coal powder containing inorganic substances.

The addition of a surface active agent to the slurry has been proposed for the purpose of solving the above-mentioned problems and enhancing the dispersibility and the stability of the solid fuel in water. Particularly, it is reported that nonionic or anionic surface active agents are effective. A solid fuel slurry having a temporarily high fluidity can be produced by adding a dispersing agent and stirring the mixture, but the sedimentation of solid fuel particles in the slurry take place even when the slurry is allowed to stand for a short time. This sediment also has problems such as a difficulty of re-dispersion because of its hardness, and the like.

The present inventors have tried to synthesize dispersing agents having specific structures in order to overcome these disadvantages. They have found that when a dispersing agent thus obtained is used to disperse the solid fuel in water a high fluidity is imparted to the dispersion even in a small amount, and the high fluidity is kept even if it is allowed to stand for a long time.

According to this invention, there is provided a slurry composition comprising a solid fuel such as pulverized coal, petroleum coke or pitch; water; and a compound having in its molecule a tricyclodecane or tricyclodecene skeleton and a sulfonic acid group attached to the skeleton.

If the solid fuel is formed into the slurry composition of this invention, the control of the amount of the solid fuel or the transportation speed becomes easy, and in addition, the following excellent properties are imparted to the solid fuel slurry:

(1) high solid concentration,
(2) low viscosity, and
(3) high stability because of neither agglomeration nor sedimentation of a pulverized solid fuel.

The dispersing agent used in this invention consists of a compound having in its molecule a tricyclodecane or tricyclodecene skeleton and a sulfonic acid group attached to the skeleton, and said compound includes, for example, (I) a sulfonation product of a (co-)polymer of a compound or compounds represented by the formula (A)

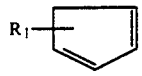

and/or the formula (B)

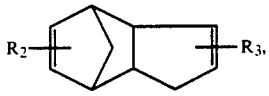

in which $R_1$, $R_2$ and $R_3$ are independently hydrogen atoms or alkyl groups having 1 to 3 carbon atoms, and a sulfonation product of the reaction product of a compound represented by the formula (C)

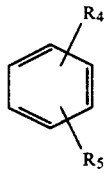

in which $R_4$ and $R_5$ are independently hydrogen atoms or alkyl groups having 1 to 6 carbon atoms, with a compound or compounds represented by the formula (A) and/or the formula (B), or a condensate of the sulfonation product; (II) a compound represented by the formula (D)

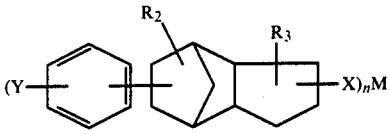

wherein $R_2$ and $R_3$ have the same meanings as defined above; X and Y are hydrogen, alkyl or $-SO_3$, at least one of X and Y being $-SO_3$; M is a hydrogen atom, an alkali metal, an alkaline earth metal, an ammonium group or a hydrocarbylammonium group; and n is 1 or 2, and/or a condensate thereof; and (III) a (co-)polymer of a compound represented by the formula (E)

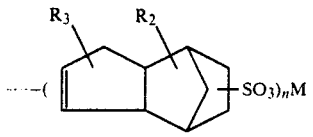

and/or a (co-)polymer of a compound represented by the formula (F)

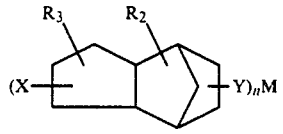

wherein $R_2$, $R_3$, X, Y, M and n are the same as defined above. Among these compounds, the compounds of (III) are most preferable because of their slight foamability. More specifically, there is used at least one member selected from the following groups (1)–(6), among which the dispersing agents of group (4) are most preferable. In addition, the tricyclodecane skeleton or tricyclodecene skeleton in this invention is represented by the formula (X):

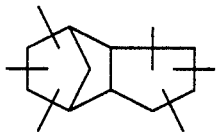

(X)

or the formula (Y):

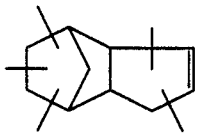

(Y)

which is tricyclo[5.2.1.$0^{2,6}$]decane or -decene, respectively.

(1) A sulfonation product of a polymer and/or a copolymer which are prepared by the polymerization of cyclopentadiene or its derivative or derivatives represented by the formula (a):

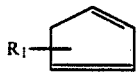

(a)

wherein $R_1$ represents a hydrogen atom or an alkyl group having 1–3 carbon atoms, or dicyclopentadiene or its derivative or derivatives represented by the formula (b):

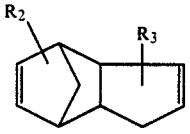

(b)

wherein $R_2$ and $R_3$, which may be the same or different, are hydrogen atoms or alkyl groups having 1–3 carbon atoms, as disclosed in Japanese Patent Application Kokai (Laid-Open) No. 152,861/83.

(2) A sulfonation product of a reaction product mixture prepared by reacting cyclopentadiene or its derivative or derivatives represented by the formula (a) or dicyclopentadiene or its derivative or derivatives represented by the formula (b) with a compound represented by the formula (c):

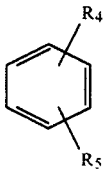

(c)

wherein $R_4$ and $R_5$, which may be the same or different, are hydrogen atoms or alkyl groups having 1–6 carbon atoms, or a condensate of said sulfonation product, as disclosed in Japanese Patent Application Kokai (Laid-Open) No. 152,862/83.

(3) A condensate obtained by condensing a sulfonated cyclopentadiene derivative represented by the formula (d):

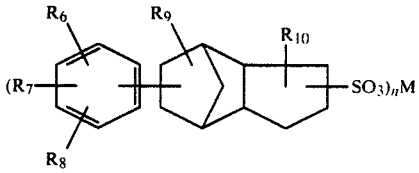

(d)

wherein $R_6$, $R_7$ and $R_8$, which may be the same or different, are hydrogen atoms or alkyl groups having 1–6 carbon atoms; $R_9$ and $R_{10}$, which may be the same or different, are hydrogen atoms or alkyl groups having 1–3 carbon atoms; n is 1 or 2; and M is a hydrogen atom, an alkali metal, an alkaline earth metal, an ammonium group or a hydrocarbylammonium group, as disclosed in Japanese Patent Application Kokai (Laid-Open) No. 152,860/83.

(4) A (co-)polymer of a sulfonated dicyclopentadiene represented by the formula (e):

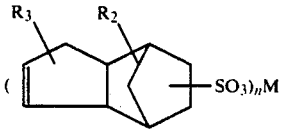

(e)

wherein $R_2$, $R_3$, n and M are the same as defined above, as disclosed in Japanese Patent Application Kokai (Laid-Open) No. 64,608/83.

(5) A (co-)polymer of a sulfonated hydroxydicyclopentadiene represented by the formula (f):

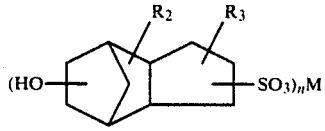

(f)

wherein $R_2$, $R_3$, n and M are the same as defined above, as disclosed in Japanese Patent Application Kokai (Laid-Open) No. 170,106/84.

(6) A condensate obtained by condensing a disulfonation product of dicyclopentadiene represented by the formula (g):

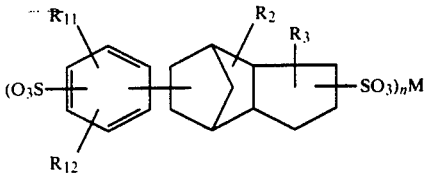

(g)

wherein $R_{11}$ and $R_{12}$, which may be the same or different, are hydrogen atoms or alkyl groups having 1–2 carbon atoms, and $R_2$, $R_3$, M and n are the same as defined above, as disclosed in Japanese Patent Application Kokai (Laid-Open) No. 170,061/84. Among the above (1) to (6) compounds, most preferable are the (4) compound in that the slurry is difficult to foam.

In the group (1), specific compounds represented by the formulas (a) and (b) include, for example, cyclopentadiene; alkylcyclopentadienes such as methylcyclopentadiene, ethylcyclopentadiene, propylcyclopentadiene and the like; and dimers which are derived from any combination thereof such as dicyclopentadiene, and the preferred compounds are cyclopentadiene or a mixture thereof.

In the group (2), specific compounds represented by the formula (c) include, for example, benzene and benzene derivatives, for example, mono- or di-alkyl-substituted benzenes and the like such as toluene, (o-, m- or p-)xylene, ethylbenzene, n-propylbenzene, isopropylbenzene, (o-, m- or p-)methylethylbenzene, n-butylbenzene, sec-butylbenzene, tert-butylbenzene, (o-, m- or p-)isopropyltoluene, amylbenzene, hexylbenzene, (o-, m- or p-)amyltoluene and the like, and the particularly preferred compounds are benzene, toluene, xylene, propylbenzene and butylbenzene.

Processes for preparing the dispersing agents used in this invention will be explained below. However, the processes for preparing the dispersing agents mentioned in the groups (1)–(6) are described in detail in Japanese Patent Application Kokai (Laid-Open) Nos. 152,861/83, 152,862/83, 152,860/83, 64,608/83, 170,106/84 and 170,061/84, respectively.

An example of preparing the dispersing agent of the group (1) is as follows:

Cyclopentadiene or its derivative or derivatives or dicyclopentadiene or its derivative or derivatives represented by the formula (a) or (b), respectively, is or are polymerized in the presence of an acidic compound catalyst such as sulfuric acid, phosphoric acid, hydrogen fluoride, boron trifluoride, a complex of boron trifluoride, aluminum chloride, aluminum bromide, tin tetrachloride, zinc chloride. titanium trichloride, or the like, and if necessary, a solvent such as a hydrocarbon, a halogenated hydrocarbon or the like at a temperature of −20° to 150° C. over a period of several hours, thereby obtaining a polymer. Said polymer is then sulfonated with a sulfonating agent such as an alkali metal bisulfite, metasulfite, sulfite or the like alone or in admixture of two or more, preferably in the presence of an inorganic oxidizing agent such as a nitrate, a nitrite or the like and a solvent such as water, methyl alcohol, ethyl alcohol or the like usually at a temperature of 50° to 200° C. at atmospheric pressure or under pressure, thereby obtaining a sulfonation product. The number average molecular weight of said polymer is preferably 10,000 or less, particularly preferably 300–5,000, from the standpoint of easy proceeding of the sulfonation of said polymer. Said sulfonation product is obtained by sulfonating the residual double bond in said polymer at 20° to 100° C. The degree of sulfonation can be determined by converting the sulfonation product thus obtained into a corresponding acid by an ion exchange method and titrating the acid with an alkali.

Said sulfonation product can be mutually converted to a corresponding acid or an alkali metal salt, an alkaline earth metal salt, an ammonium salt or a hydrocarbylammonium salt by an ion exchange method or a neutralization reaction.

An example of preparing the dispersing agent of the group (2) is explained below.

Cyclopentadiene or its derivative or derivatives or dicyclopentadiene or its derivative or derivatives represented by the formula (a) or (b) and a compound represented by the formula (c) are reacted in the presence of said acidic compound catalyst and a solvent usually at a temperature of −20° to 150° C., thereby obtaining a reaction product mixture. This reaction product mixture comprises not only several addition products including the reaction product in which one molecule of the compound represented by the formula (c) has been added to one molecule of a cyclopentadiene or dicyclopentadiene and the reaction product in which one molecule of a compound represented by the formula (c) has been added to two molecules of a cyclopentadiene or dicyclopentadiene, but also the polymer of a cyclopentadiene and/or a dicyclopentadiene and the reaction product in which a compound represented by the formula (c) has been added to the polymer, and the like. (The number average molecular weight of said reaction product mixture is preferably 10,000 or less from the standpoint of the readiness of the sulfonation reaction which will be explained hereinafter.)

Said reaction product mixture is sulfonated in the same manner as the sulfonation reaction of the polymer described in the preparation of the dispersing agent of the group (1), thereby obtaining a sulfonation product of the reaction product mixture. Said sulfonation product as a monomer for condensation is subjected, if necessary, together with other monomers for condensation such as benzene, toluene, xylene, phenol and the like, to condensation with an aldehyde such as formaldehyde, acetaldehyde, propionaldehyde or the like in the presence of usually 0.001–10 moles of an acid catalyst such as sulfuric acid per mole of the total monomers for condensation.

The number average molecular weight of the condensate is preferably 500–30,000 from the standpoint of the dispersion effect of solid fuel.

An example of preparing the dispersing agent of the group (3) is explained below.

Friedel-Crafts reaction is carried out using a compound represented by the formula (h):

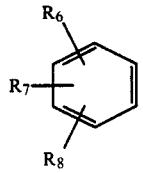

(h)

wherein $R_6$, $R_7$ and $R_8$ have the same meanings as defined above, for example, benzene, toluene, xylene, propylbenzene, butylbenzene or the like, and a compound represented by the formula (i):

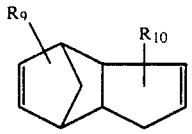

(i)

wherein $R_9$ and $R_{10}$ have the same meanings as defined above, for example, dimers of cyclopentadiene, methylcyclopentadiene, ethylcyclopentadiene and the like, in the presence of a catalyst such as sulfuric acid, phosphoric acid, hydrogen fluoride, boron trifluoride, a complex of boron trifluoride, aluminum chloride, aluminum bromide or the like, preferably at a temperature of 0° to 100° C. for 1 to 5 hours, thereby obtaining a compound represented by the formula (j):

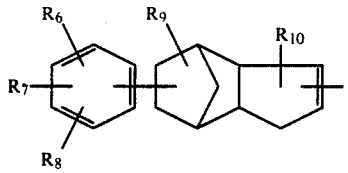

(j)

wherein $R_6$, $R_7$, $R_8$, $R_9$ and $R_{10}$ have the same meanings as defined aboe.

The compound represented by the formula (j) is sulfonated in the same manner as in the sulfonation of the polymer described in the preparation of the dispersing agent of the group (1), and then if necessary, converted to a sulfonic acid salt by the use of an alkali metal, an alkaline earth metal, ammonia or an amine, thereby obtaining the sulfonation product of a cyclopentadiene derivative represented by the formula (d).

Said sulfonation product is condensed in the same manner as in the preparation of the condensate described in the preparation of the dispersing agent of the group (2), thereby obtaining a condensate.

In said formula (d), if M is hydrogen, an alkali metal, an ammonium group or a hydrocarbylammonium group, n=1, and if M is an alkaline earth metal, n=2.

Said alkali metals include sodium, potassium, and the like. Amines from which the hydrocarbylammonium group has been derived include alkylamines such as methylamine, ethylamine, propylamine, dimethylamine, diethylamine, trimethylamine, triethylamine, butylamine, dibutylamine, tributylamine and the like; polyamines such as ethylenediamine, diethylenetriamine, triethylenetetramine and the like; morpholine; piperidine; and the like. Alkaline earth metals include calcium, magnesium, zinc and the like. These kinds of M can be exchanged mutually to the other kinds of M by various ion exchange methods or neutralization reactions.

An example of the preparation of the dispersing agent of the group (4) is explained below.

A dicyclopentadiene is sulfonated in the same manner as in the sulfonation of the polymer described in the preparation of the dispersing agent of the group (1), and then if necessary, converted to a corresponding sulfonic acid salt, thereby obtaining a compound represented by the formula (e). Said compound is polymerized in the same manner as in the preparation of the polymer described in the preparation of the dispersing agent of the group (1), thereby obtaining a polymer. In the polymerization reaction, if a comonomer such as aliphatic, alicyclic or aromatic hydrocarbon having an olefinic double bond is present, a copolymer is obtained.

The number average molecular weight of said (co-)polymer is preferably 500 or more, more preferably 1,500–50,000, from the standpoint of the dispersion effect of solid fuel.

An example of the preparation of the dispersing agent of the group (5) is explained below.

The same procedure as in the preparation of the dispersing agent of the group (4) is repeated except that a hydroxydicyclopentadiene is substituted for the dicyclopentadiene which is the starting material for the preparation of the dispersing agent of the group (4).

The number average molecular weight of the (co-)polymer is preferably 500 or more, more preferably 1,500–50,000 from the standpoint of the dispersion effect of solid fuel.

An example of the preparation of the dispersing agent of the group (6) is explained below.

A compound represented by the formula (k):

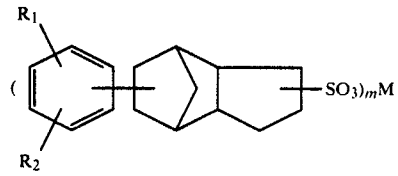

(k)

wherein $R_1$, $R_2$ and M have the same meanings as defined above, and m is 1 or 2, is obtained by adding, for example, sodium bisulfite to the product of the Friedel-Crafts reaction of a dicyclopentadiene and benzene or a benzene derivative in the presence of a catalyst such as $BF_3$, and if necessary, convering the addition product into a corresponding sulfonic acid salt.

The disulfonation product represented by the formula (g) is obtained by reacting the compound represented by the formula (k) with a sulfuric acid such as sulfuric acid, sulfuric anhydride, fuming sulfuric acid or the like [in an amount of preferably 0.1–5 moles per mole of the compound represented by the formula (k)] preferably at a temperature of 50° to 150° C. A condensate is obtained by condensing said disulfonation product in the same manner as in the condensation described in the preparation of the dispersing agent of the group (2).

One or more of said dispersing agents are added, if necessary together with a surface active agent, an additive and the like, to an aqueous solid fuel slurry having a solid fuel concentration of 50 to 90% by weight, preferably 60 to 85% by weight (this concentration is not critical).

If the amount of the dispersing agent added is increased, the viscosity of the solid fuel slurry is lowered, so that the amount can be varied depending upon the desired viscosity. It is usually sufficient that the amount of the dispersing agent added ranges from 0.01 to 10% by weight, preferably from 0.05 to 1% by weight from the standpoint of workability and economy.

Surface active agents which are optionally used in the slurry composition of this invention include nonionic or anionic surface active agents. Nonionic surface active agents include, for example, alkylpolyetheralcohols, alkylarylpolyetheralcohols, polyoxyethylene fatty acid esters, polyoxyethylenesorbitan fatty acid esters, polyalkylene oxide block copolymers and the like, and commercially available products formed by blending them such as of ethylene oxide type, diethanolamine type, anhydrosorbitol type, glycoside type, gluconamide type, glycerol type, glycidol type and the like may be used as a dispersing agent or a solid fuel wetting agent. Anionic surface active agents include, for example, dodecylbenzenesulfonic acid salt, oleic acid salts, alkylbenzenesulfonic acid salts, dialkylsulfosuccinic acid salts, ligninsulfonic acid salts, alcohol ethoxysulfates, sec-alkanesulfonates, α-olefinsulfonic acids, Tamol and the like. Commercially available products formed by blending them such as of carboxylic acid type, sulfate type, sulfonate type, phosphate type, alkylarylsulfonate type, and the like may be used as a dispersing agent or a solid fuel-wetting agent.

The additives include, for example, chelating agents for polyvalent metal trap such as EDTA, sodium tripolyphosphate, potassium tetrapolyphosphate, sodium citrate, sodium gluconate, polysodium acrylate, polycarboxylic acid and the like. An antifoaming agent may also be added in order to suppress foaming, and a silicone emulsion or the like may be used as the anti-foaming agent. It is also possible to add a freezing point-depressing agent in order to prevent freezing in winter. A lower alcohol or a polyhydric alcohol such as ethylene glycol or the like may be used as the freezing point-depressing agent.

Coal for use in a coal-water slurry may be any of anthracite, bituminous coal, sub-bituminous coal, brown coal, cleaned product thereof, coke, a mixture of pulverized coal and an oil, or the like. The particle size of coal may be any particle size as far as it is in the form of powder. The pulverized coal to be burnt in a thermoelectric power plant is of at least 70% passing through 200 mesh (Tyler), so that this particle size may be a standard. However, the dispersing agent used in this invention is not affected by the particle size, and it has an excellent effect on coal powder having any particle size.

The pulverization of petroleum coke used in this invention may be carried out by a dry method or a wet method which is carried out in water. The wet method is preferred because of no problem of powder dust. Although the particle size of petroleum coke is not critical it is preferred that at least 70% by weight of the coke passes through a wire net with 200 mesh (Tyler), and more preferably, at least 90% by weight passes therethrough. However, the dispersing agent used in this invention is not affected by the particle size, and it has an excellent effect on petroleum coke powder having any particle size.

The pitch used in this invention includes petroleum pitch and coal pitch, and those having a softening point of 50° to 180° C. are preferred. Also the size of the powder is preferably the same as the sizes of the above-mentioned coal powder or petroleum coke powder.

The process for producing the slurry of this invention is not critical, and comprises mixing the solid fuel, water and the dispersing agent by any desired method. For example, a solid fuel is previously pulverized by a dry method and the pulverized solid fuel is thereafter mixed with an aqueous solution of the dispersing agent therein; a solid fuel slurry is first prepared and the dispersing agent is thereafter added thereto; or a solid fuel, water and the dispersing agent are placed in a mill and they are stirred while pulverizing the solid fuel. Moreover, in these methods, cleaned solid fuel may be substituted for the solid fuel.

The dispersing agent used in this invention gives a high fluidity to the solid fuel slurry even when it is used in an extremely small amount, and it has an effect of stably dispersing the solid fuel in water over a long period of time, so that it is possible to prepare a solid fuel slurry having a high concentration which can be transported by pump.

This invention is explained in more detail referring to Examples and Referential Examples, which are by way of illustration and not by way limitation. Percentages in the Examples and the Referential Examples are by weight, unless otherwise specified.

REFERENTIAL EXAMPLE 1

In a 1-liter, three-necked flask provided with a reflux condensor and a stirrer were placed 400 g of n-hexane and 4 g of a boron trifluoride-phenol complex, and the temperature was raised up to 50° C., after which 140 g of dicyclopentadiene having a purity of 95% was added dropwise over a period of about 1 hour with stirring. The mixture obtained was further subjected to reaction at this temperature for 2 hours. After completion of the reaction, an aqueous sodium carbonate solution was added to the reaction mixture to decompose the catalyst, and the reaction mixture was washed with water. The organic layer was distilled under reduced pressure to remove n-hexane and unreacted dicyclopentadiene. The weight of the residue obtained amounted to 78 g, and the number average molecular weight thereof was 2,100. By a quantitative analysis of the residual double bond in the residue by iodometry, it was found that 0.83 mole of the double bond remained per mole of the reacted dicyclopentadiene.

Then, in a 1-liter stainless steel autoclave provided with a stirrer and a thermometer were placed 20 g of said residue, 30 g of toluene, 20 g of sodium hydrogensulfite, 2 g of potassium nitrate, 300 ml of isopropyl alcohol and 50 g of water, and air was supplied until the internal pressure of the autoclave reached 1.0 kg/cm$^2$ (gauge pressure), after which the valve was closed tightly. The contents were subjected to reaction with vigorous stirring at a temperature of 110° C. for 5 hours. Then, the reaction mixture was allowed to stand at room temperature, and most of isopropyl alcohol was removed by distillation, after which 1 liter of distilled water and 1.5 liters of petroleum ether were added to the residue, and the mixture was sufficiently stirred. Separated petroleum ether layer and precipitates were removed, and the water layer obtained was concentrated and then evaporated to dryness. It was dissolved in glacial acetic acid and the acetic acid-insoluble matter consisting of inorganic salts was separated by filtration. The acetic acid-soluble matter obtained was concentrated to obtain 1.87 g of whitish yellow solid. This was named "Sample 1".

REFERENTIAL EXAMPLE 2

The same procedure as in Referential Example 1 was repeated, except that cyclopentadiene was substituted for the dicyclopentadiene and the reaction was effected at a temperature of 30° C., whereby 68 g of the residue was obtained. The number average molecular weight of this residue was 5,600. The residual double bond in the residue was quantitatively analyzed in the same manner as in Referential Example 1, to find that 0.90 mole of the double bond remained per mole of the reacted cyclopentadiene.

Then, sulfonation was carried out in the same manner as in Referential Example 1, to obtain 14.3 g of whitish yellow solid, which was named "Sample 2".

REFERENTIAL EXAMPLE 3

In a 3-liter, three-necked flask provided with a reflux condensor and a stirrer were placed 1,270 g of toluene and 12 g of a boron trifluoride-phenol complex, and the temperature was raised up to 50° C., after which a mixture of 417 g of dicyclopentadiene and 320 g of toluene was added dropwise over a period of 1 hour with stirring. The mixture obtained was further subjected to reaction at this temperature for 2 hours. After completion of the reaction, an aqueous sodium carbonate solution was added to the reaction mixture to decompose the catalyst, and the mixture was washed with water. The organic layer was distilled under reduced pressure to obtain 1,360 g of unreacted toluene and 35 g of dicyclopentadiene as distillates, while 601 g of the residue was obtained. The residual double bond in the residue was quantitatively analyzed by iodometry, to find that 0.96 mole of the double bond remained per mole of the reacted dicyclopentadiene. When the molecular weight distribution of the residue was measured by gel permeation chromatography (GPC), it was found that there were compounds having various molecular weights including a compound having a molecular weight of 224 in which 1 mole of toluene was added to 1 mole of dicyclopentadiene (about 63% by weight) and a compound having a polystyrene reduced molecular weight of 8,000.

Then, in a 3-liter stainless steel autoclave provided with a stirrer and a thermometer were placed 20 g of said residue, 20 g of sodium hydrogensulfite, 2 g of potassium nitrate, 300 ml of isopropyl alcohol and 50 g of distilled water, and air was supplied until the internal pressure of the autoclave reached 1.0 kg/cm$^2$ (gauge pressure), after which the valve was closed tightly. The contents were subjected to reaction with vigorous stirring at a temperature of 110° C. for 3 hours, and then allowed to stand at room temperature, after which most of isopropyl alcohol was removed by distillation. Then, 1 liter of distilled water and 1.5 liters of petroleum ether were added to the residue, and the resulting mixture was sufficiently stirred. The separated petroleum ether layer and precipitates were removed, and the aqueous layer thus obtained was concentrated and evaporated to dryness. The residue was dissolved in glacial acetic acid, and the acetic acid-insoluble matter consisting of inorganic salts was separated by filtration. The acetic acid-soluble matter obtained was concentrated to obtain 25.8 g of yellow solid, which was named "Sample 3".

REFERENTIAL EXAMPLE 4

Reaction was conducted by repeating the same procedure as in Referential Example 3, except that 1,510 g of ethylbenzene was substituted for the 1,270 g of toluene charged at the first stage and 320 g of ethylbenzene was substituted for the 320 g of toluene added dropwise, whereby 1,590 g of unreacted ethylbenzene and 52 g of dicyclopentadiene were obtained as distillates, and 588 g of the residue was obtained. The residual double bond in this residue was quantitatively analyzed by iodometry, to find that 0.95 mole of the double bond remained per mole of the reacted dicyclopentadiene.

By measuring the molecular weight distribution of the residue in the same manner as in Referential Example 3, it was found that there were compounds having various molecular weights including a compound having a molecular weight of 238 in which 1 mole of ethylbenzene was added to 1 mole of dicyclopentadiene (about 58% by weight) and a compound having a polystyrene reduced molecular weight of 11,000.

Subsequently, in the same manner as in Referential Example 3, sulfonation was conducted to obtain 23.8 g of a yelllow solid, which was named "Sample 4".

REFERENTIAL EXAMPLE 5

In a 0.2-liter, three-necked flask provided with a stirrer and a thermometer were placed 30 millimoles of the Sample 3 obtained in Referential Example 3, 30 millimoles of formaldehyde, 30 millimoles of sulfuric acid and 270 millimoles of distilled water, and the mixture was subjected to reaction at a temperature of 80° C. for 24 hours. After 100 g of distilled water was added to the reaction mixture, potassium carbonate was added with stirring thereto to adjust the pH to 7, and the mixture thus obtained was filtrated to obtain a filtrate. Furthermore, potassium carbonate was added with stirring to this filtrate to adjust the pH to 9, and the resulting mixture was filtered to obtain a filtrate. This filtrate was evaporated to dryness to obtain 11.6 g of pale brown powder, which was named "Sample 5".

By measuring the molecular weight distribution of the Sample 5 by aqueous GPC, it was found that the proportion of compunds having a molecular weight of 500 or less was 5% by weight or less of the whole, and a large peak appeared at a molecular weight of 4,300.

REFERENTIAL EXAMPLE 6

In a 3-liter, three-necked flask provided with a reflux condenser and a stirrer were placed 1,270 g of toluene and 12 g of a boron trifluoride-phenol complex, and the temperature of the contents was raised up to 50° C., after which a mixed solution of 417 g of dicyclopentadiene and 320 g of toluene was added dropwise to the contents over a period of about 1 hour with stirring. The mixture was further subjected to reaction at this temperature for 2 hours. After completion of the reaction, an aqueous sodium carbonate solution was added to the reaction mixture to decompose the catalyst, and the mixture was washed with water. The organic layer was distilled under reduced pressure to obtain 423 g of the toluene adduct of dicyclopentadiene.

Then, in a 3-liter stainless steel autoclave provided with a stirrer and a thermometer were placed 200 g of the toluene adduct of dicyclopentadiene, 97.8 g of sodium hydrogensulfite, 8.0 g of potassium nitrate, 1,360 ml of isopropyl alcohol and 200 ml of distilled water, and air was supplied until the internal pressure of the autoclave reached 1.0 kg/cm$^2$ (gauge pressure) at room temperature, after which the valve was closed tightly. The mixture was subjected to reaction with vigorous stirring at a temperature of 110° C. for 5 hours. After the reaction mixture was allowed to stand at room temperature, it was discharged, and 50 ml of distilled water and 1,500 ml of petroleum ether were added thereto. The resulting mixture was sufficiently stirred, and the seprated petroleum ether layer and precipitates were removed, after which the residue was concentrated and evaporated to dryness to obtain 139 g of pale yellow powder. This powder was subjected to extraction with petroleum ether in a Soxlet's extractor for 1 hour to extract and remove the unreacted substances, and the residual solution was evaporated and dissolved again in 300 ml of glacial acetic acid to remove the acetic acid-insoluble matter consisting of inorganic salts by filtration. The acetic acid-soluble matter thus obtained was concentrated to obtain 129 g of a whitish yellow solid. This solid was purified by ethanol extraction to obtan the sodium salt of a sulfonation product of the toluene adduct of dicyclopentadiene.

Then, in a 0.2-liter, three-necked flask provided with a stirrer and a thermometer were placed 30 millimoles of the sodium salt, 30 millimoles of formaldehyde, 30 millimoles of sulfuric acid and 270 millimoles of distilled water, and condensation reaction was carried out at a temperature of 80° C. for 24 hours. To the reaction mixture was added 100 g of distilled water, and calcium carbonate was then added with stirring to adjust the pH to 7, after which the mixture thus obtained was filtrated to obtain a filtrate.

To this filtrate was added sodium carbonate to adjust the pH to 9, and then the mixture was filtrated to obtain a filtrate. This filtrate was evaporated to dryness to obtain 11.2 g of pale brown powder, which was named "Sample 6".

By measuring the molecular weight by aqueous GPC, it was found that the number average molecular weight was 4,900.

REFERENTIAL EXAMPLE 7

Reaction was carried out in the same manner as in Referential Example 6, except that 350 g of dicyclopentadiene and 1,060 g of xylene were substituted for the toluene, to obtain 340 g of the xylene adduct of dicyclopentadiene.

Reaction was carried out in the same manner as in Referential Example 6, except that 200 g of the xylene adduct was used, to obtain 124 g of the sodium salt of the sulfonation product of the xylene adduct, which was named "Sample 7".

The condensation reaction was carried out using the sodium salt in the same manner as in Referential Example 6, and 10.3 g of pale powder was obtained. Measuring the molecular weight by aqueous GPC, it was found that the number average molecular weight was 5,400.

REFERENTIAL EXAMPLE 8

In a 30-liter stainless steel autoclave provided with a stirrer and a thermometer were placed 3,000 g of dicyclopentadiene, 1,888 g of sodium hydrogensulfite, 91.7 g of potassium nitrate, 12 liters of isopropyl alcohol and 3,000 g of distilled water, and nitrogen was fed to the autoclave until the internal pressure reached 1.0 kg/cm$^2$ (gauge pressure), after which the valve was then closed tightly, and the contents were subjected to reaction with vigorous stirring at 110° C. for 5 hours. Then, the contents were allowed to stand at room temperature, and most of isopropyl alcohol was removed by distillation, after which distilled water and petroleum ether were added. The resulting mixture was sufficiently agitated. The separated petroleum ether layer and precipitates were removed, and the aqueous layer thus obtained was concentrated and evaporated to dryness. The residue was dissolved in glacial acetic acid, and the acetic acid-insoluble matter consisting of inorganic salts was separated by centrifuge. The acetic acid-soluble matter thus obtained was concentrated to obtain 2,800 g of a white solid, named "Sulfonated Product A"

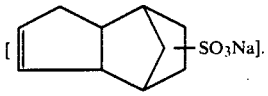

An aqueous solution of the Sulfonated Product A was subjected to ion-exchange resin to convert the product to the corresponding acid, and water was removed by distillation to obtain the acid type of the sulfonation product, which was named "Sulfonated Product B"

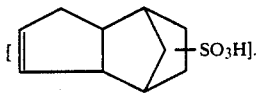

Then, in a 300-ml, three-necked flask provided with a reflux condenser and a stirrer were placed 15 g of the Sulfonated Product B and 6.88 g of sulfuric acid, and the polymerization reaction was carried out at a temperature of 120° C. for 26 hours. After completion of the reaction, liming and sodation were carried out, and the solid fraction obtained amounted to 15.5 g. The number average molecular weight of this polymer was 10,000, and it was named "Sample 8".

REFERENTIAL EXAMPLE 9

The same procedure as in Referential Example 8 was repeated, except that the Sulfonation Product A was substituted for the Sulfonation Product B, thereby obtaining a polymer having a number average molecular weight of 1,600, and it was named "Sample 9".

REFERENTIAL EXAMPLE 10

In the same, three-necked flask were placed 30 g of the Sulfonation Product A, 125 g of sulfuric acid and 11.4 g of water, and the polymerization reaction was carried out at a temperature of 170° C. for 28 hours. Then, the same procedure as in Referential Example 8 was repeated, thereby obtaining a polymer having a number average molecular weight of 8,000, which was named "Sample 10".

REFERENTIAL EXAMPLE 11

In a 300-ml, three-necked flask provided with a reflux condenser and a stirrer were placed 13 g of the Sulfonation Product A, 2 g of dicyclopentadiene and 6.88 g of sulfuric acid, and the copolymerization reaction was carried out at 120° C. for 20 hours. When liming and sodation were carried out after the reaction, the solid fraction obtained amounted to 15.0 g. It was named "Sample 11".

REFERENTIAL EXAMPLE 12

In a 300-ml, three-necked flask provided with a reflux condenser and a stirrer were placed 15 g of the sulfonation product of hydroxydicyclopentadiene (a compound having the formula (f), wherein M=H) and 6.88 g of sulfuric acid, and the polymerization reaction was carried out at 120° C. for 23 hours. When liming was carried out using calcium carbonate ($SO_3$ was removed and M=H was converted to M=Ca) and sodation was carried out using sodium carbonate (M=Ca was converted to M=Na) after the reaction, the solid fraction obtained amounted to 15.5 g and the number average molecular weight of the polymer was 10,000. The polymer was named "Sample 12".

REFERENTIAL EXAMPLE 13

In a 300-ml, three-necked flask provided with a reflux condenser and a stirrer were placed 8 g of the sulfonation product of hydroxydicyclopentadiene (a compound having the formula (f), wherein M=H), 7 g of the sulfonation product of dicyclopentadiene (structural formula:

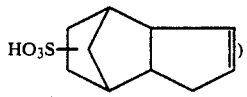

and 6.88 g of sulfuric acid, and the copolymerization reaction was carried out at 120° C. for 2 hours. When liming and sodation were carried out after the reaction, the amount of the solid obtained was 15.5 g. It was named "Sample 13".

REFERENTIAL EXAMPLE 14

In a 300-ml, three-necked flask provided with a reflux condenser and a stirrer were placed 13 g of the sulfonation product of hydroxydicyclopentadiene (a compound having the formula (f), wherein M=H), 2 g of acrylic acid and 6.88 g of sulfuric acid, and the copolymerization reaction was carried out at 120° C. for 2 hours. When liming and sodation were carried out after the reaction, the amount of the solid fraction obtained was 15.4 g. It was names "Sample 14".

REFERENTIAL EXAMPLE 15

In a 3-liter, three-necked flask provided with a reflux condenser and a stirrer were placed 1,270 g of toluene and 12 g of a boron trifluoride-phenol complex, and the temperature of the contents was raised up to 50° C., after which a mixed solution of 417 g of dicyclopentadiene and 320 g of toluene was added dropwise with stirring over a period of about 1 hour. The resulting mixture was subjected to reaction at this temperature for 2 hours. After completion of the reaction, an aqueous sodium carbonate solution was added to the reaction mixture to decompose the catalyst, and said mixture was washed with water. Then, the organic layer was evaporated under reduced pressure to obtain 423 g of the toluene adduct of dicyclopentadiene.

Then, in a 3-liter stainless steel autoclave provided with a stirrer and a thermometer were placed 200 g of the toluene adduct of dicyclopentadiene, 97.8 g of sodium hydrogensulfite, 8.0 g of potassium nitrate, 1,360 ml of isopropyl alcohol and 200 ml of water, and air was fed to the autoclave until the internal pressure thereof was 1.0 kg/cm$^2$, after which the valve was then closed tightly. The resulting mixture was subjected to reaction with vigorous stirring at 110° C. for 5 hours. The contents of the reactor were allowed to stand at room temperature, and then discharged, after which 50 ml of distilled water and 1,500 ml of petroleum ether were added thereto. The resulting mixture was sufficiently stirred, and the separated petroleum ether layer and precipitates were removed, after which the residue was concentrated and evaporated to dryness, thereby obtaining 139 g of pale yellow powder. The powder was extracted with petroleum ether in a Soxlet's extractor for 1 hour to remove the unreacted compounds, and the residual solution was dried and dissolved in 300 ml of glacial acetic acid, after which the acetic acid-insoluble matter consisting of inorganic salts was separated by filtration. The acetic acid-soluble fraction thus obtained was concentrated, whereby 129 g of whitish yellow solid was obtained. This solid was purified by ethanol extraction, whereby a sodium salt of the sulfonation product of the toluene adduct of dicyclopentadiene was obtained. This sodium salt of the sulfonation product of the toluene adduct of dicyclopentadiene is named "Product A'".

Subsequently, 60 millimoles of the Product A', and 80 millimoles of sulfuric acid were placed in a 0.2-liter, three-necked flask provided with a stirrer and a thermometer, and the resulting mixture was subjected to reaction at 100° C. for 3 hours and then at 110° C. for 2 hours, after which 10 cc of n-heptane was added, to the reaction mixture. The n-heptane and water were thereafter removed by azeotropic distillation under reduced pressure at 80° C. The product obtained by this reaction was named "Product B'".

To the product B' was added 6.3 g of water, and 5.35 g (66 millimoles) of 37% aqueous formaldehyde solution was added dropwise thereto at 80° C. over a period of 3 hours, after which the resulting mixture was then heated to 100° C., and subjected to condensation reaction for 20 hours to obtain a viscous product, which was named "Product C'". To the Product C' was added 100 g of water to form a solution, and 11 g of calcium carbonate was added thereto to adjust the pH to 7, after which the white precipitate formed was removed by filtration. To the filtrate thus obtained was further added 3.2 g of sodium carbonate, and the white precipitate produced was removed by filtration. Then, the filtrate thus obtained was evaporated to dryness, which was named "Sample 15".

In addition, the number average molecular weight of the Sample 15 was determined to be 6,300 by GPC.

EXAMPLES 1-20 AND COMPARATIVE EXAMPLE 1-3

The coal used was produced in Australia, and contained 95% of particles passing through 200 mesh (Tyler), 8.7% of ash, and 2.0% of sulfur. Each coal slurry was prepared by placing a dispersing agent as described in Table 1 in water, slowly adding thereto the coal particles in a predetermined amount, and stirring the mixture in a homomixer at 5,000 rpm for 30 minutes. The concentration of the coal and the amount of the dispersing agent added are shown in Table 1.

The viscosity of the coal slurry thus obtained was measured at 25° C. The result thereof is shown in Table 1. The slurry was then allowed to stand, and the viscosity was measured with the lapse of time to observe the stability.

It can be seen from Table 1 that the slurry composition of this invention is superior.

TABLE 1

| No. | Dispersing agent | Amount of dispersing agent added (% based on slurry) | Slurry concentration (wt %) | Viscosity of slurry (cp) | Viscosity of* slurry after 10 days (cp) |
|---|---|---|---|---|---|
| Example 1 | Sample 1 | 0.1 | 65 | 1230 | 1310 |
| Example 2 | Sample 2 | 0.1 | 65 | 1630 | 1700 |
| Example 3 | Sample 3 | 0.1 | 65 | 1730 | 1790 |
| Example 4 | Sample 4 | 0.1 | 65 | 1960 | 1980 |
| Example 5 | Sample 5 | 0.1 | 65 | 1700 | 1740 |
| Example 6 | Sample 6 | 0.1 | 65 | 1080 | 1130 |
| Example 7 | Sample 7 | 0.1 | 65 | 1320 | 1380 |
| Example 8 | Sample 8 | 0.1 | 65 | 720 | 860 |
| Example 9 | Sample 9 | 0.1 | 65 | 1790 | 1930 |
| Example 10 | Sample 10 | 0.1 | 65 | 860 | 870 |
| Example 11 | Sample 11 | 0.1 | 65 | 1200 | 1290 |
| Example 12 | Sample 12 | 0.1 | 65 | 780 | 830 |
| Example 13 | Sample 13 | 0.1 | 65 | 710 | 730 |
| Example 14 | Sample 14 | 0.1 | 65 | 830 | 830 |
| Example 15 | Sample 15 | 0.1 | 65 | 1230 | 1270 |
| Comp. Ex. 1 | High condensate of naphthalene-sulfonic acid | 0.1 | 65 | 1180 | Caking (not re-dispersed) |
| Comp. Ex. 2 | Low condensate of naphthalene-sulfonic acid | 0.1 | 65 | 1760 | Caking (not re-dispersed) |
| Example 16 | Sample 9 | 0.5 | 65 | 630 | 660 |
| Example 17 | Sample 9 | 1.0 | 65 | 380 | 390 |
| Example 18 | Sample 9 | 0.5 | 70 | 930 | 970 |
| Example 19 | Sample 15 | 1.0 | 70 | 1170 | 1190 |
| Example 20 | Sample 8 | 0.05 | 65 | 720 | 740 |
| Comp. Ex. 3 | None | — | 65 | 50,000 or more | — |

Note:
*Measured after re-dispersion in a homomixer at 5,000 rpm for 1 minute.

EXAMPLES 21–23

Tests were carried out using domestic bituminous coal, sub-bituminous coal and anthracite having 73, 76 and 83% of particles passing through 200 mesh (Tyler), respectively, according to the procedure in Example 1. The coal slurry concentration was 65%. The results obtained are shown in Table 2.

TABLE 2

| Example No. | Kind of coal | Kind of dispersing agent | Amount of dispersing agent (% based on slurry | Viscosity of slurry (cp) | Viscosity of slurry after 10 days (cp) |
|---|---|---|---|---|---|
| 21 | Bituminous coal | Sample 8 | 0.5 | 690 | 720 |
| 22 | Sub-bituminous coal | Sample 1 | 0.5 | 1090 | 1160 |
| 23 | Anthracite | Sample 12 | 0.5 | 580 | 600 |

EXAMPLES 24–42 AND COMPARATIVE EXAMPLES 4–6

A petroleum coke containing 97% of particles passing through 200 mesh (Tyler), 0.67% of ash and 0.36% of sulfur was used for the test. A petroleum coke-water slurry was prepared by adding a dispersing agent as described in Table 3 to water, slowly adding the predetermined amount of petroleum coke, and stirring the mixture in a homomixer at 5,000 rpm for 10 minutes. The concentration of the petroleum coke and the amount of the dispersing agent added are shown in Table 3.

The viscosity of the slurry thus obtained was measured at 25° C. and the result obtained is shown in Table 3. Also, the viscosity of the slurry which had been allowed to stand for 10 days was measured to check its stability.

From Table 3, it can be seen that the petroleum coke-water slurry composition of this invention is superior.

TABLE 3

| No. | Kind of dispersing agent | Amount of dispersing agent (% based on slurry) | Concentration of slurry (wt %) | Viscosity of slurry (cp) | Viscosity of* slurry after 10 days (cp) |
|---|---|---|---|---|---|
| Example 24 | Sample 1 | 0.1 | 62 | 290 | 310 |
| Example 25 | Sample 2 | 0.1 | 62 | 260 | 260 |
| Example 26 | Sample 3 | 0.1 | 62 | 300 | 310 |
| Example 27 | Sample 4 | 0.1 | 62 | 270 | 290 |
| Example 28 | Sample 5 | 0.1 | 62 | 240 | 250 |
| Example 29 | Sample 6 | 0.1 | 62 | 230 | 270 |
| Example 30 | Sample 7 | 0.1 | 62 | 270 | 310 |
| Example 31 | Sample 8 | 0.1 | 62 | 260 | 260 |
| Example 32 | Sample 9 | 0.1 | 62 | 180 | 190 |
| Example 33 | Sample 10 | 0.1 | 62 | 250 | 260 |
| Example 34 | Sample 11 | 0.1 | 62 | 200 | 200 |

TABLE 3-continued

| No. | Kind of dispersing agent | Amount of dispersing agent (% based on slurry) | Concentration of slurry (wt %) | Viscosity of slurry (cp) | Viscosity of* slurry after 10 days (cp) |
|---|---|---|---|---|---|
| Example 35 | Sample 12 | 0.1 | 62 | 270 | 280 |
| Example 36 | Sample 13 | 0.1 | 62 | 240 | 250 |
| Example 37 | Sample 14 | 0.1 | 62 | 270 | 260 |
| Example 38 | Sample 15 | 0.1 | 62 | 250 | 280 |
| Example 39 | Sample 9 | 0.5 | 62 | 70 | 70 |
| Example 40 | Sample 9 | 0.5 | 65 | 290 | 300 |
| Example 41 | Sample 8<br>Sample 6 | 0.05<br>0.05 | 62 | 240 | 250 |
| Example 42 | Sample 9 | 0.05 | 62 | 370 | 380 |
| Comp. Ex. 4 | — | — | 62 | 100,000 or more | — |
| Comp. Ex. 5 | High-condensate of naphthalene-sulfonic acid | 0.1 | 62 | 340 | Caking (unmeasurable) |
| Comp. Ex. 6 | Low-condensate of naphthalene-sulfonic acid | 0.1 | 62 | 280 | Caking (unmeasurable) |

Note:
*Measured after re-dispersion in a homomixer for 1 minute.

EXAMPLES 43–46

The same procedure as in Example 24 was repeated using a petroleum coke containing 84% of particles passing through 200 mesh (Tyler). Tests were carried out at a slurry concentration of 62% by weight, and the results obtained are shown in Table 4.

TABLE 4

| | Kind of dispersing agent | Amount of dispersing agent (% based on slurry) | Viscosity of slurry (cp) | Viscosity of slurry after 10 days (cp) |
|---|---|---|---|---|
| Example 43 | Sample 1 | 0.1 | 530 | 540 |
| Example 44 | Sample 6 | 0.1 | 500 | 500 |
| Example 45 | Sample 9 | 0.1 | 450 | 470 |
| Example 46 | Sample 12 | 0.1 | 570 | 580 |

REFERENTIAL EXAMPLE 16

The same procedure as in Referential Example 8 was repeated, except that 10 g of sulfuric acid was used and the polymerization was effected for 6 hours.

The amount of the solid obtained was 14 g, and the solid was a polymer having a number average molecular weight of 8,850. This was named "Sample 16".

The surface tension of 4% aqueous solution of this polymer was 69.7 dyn/cm.

REFERENTIAL EXAMPLE 17

The same procedure as in Referential Example 16 was repeated, except that the polymerization temperature was changed from 120° C. to 130° C., thereby obtaining a polymer. The weight average molecular weight of the polymer (hereinafter referred to as Sample 17) was 13,400, and the surface tension of 4% aqueous solution of the polymer was 70.6 dyn/cm.

REFERENTIAL EXAMPLE 18

The same procedure as in Referential Example 16 was repeated, except that the polymerization temperature was varied from 120° C. to 100° C., thereby obtaining a polymer. The weight average molecular weight of the polymer obtained (hereinafter referred to as Sample 18) was 2,200, and the surface tension of 4% aqueous solution of the polymer was 64.8 dyn/cm.

REFERENTIAL EXAMPLE 19

The same procedure as in Referential Example 16 was repeated, except that a mixture of 1.5 g of acrylic acid and 13.5 g of the Sulfonation Product A were substituted for the 15 g of the Sulfonation Product A to obtain a copolymer. The weight average molecular weight of the copolymer obtained (hereinafter referred to as Sample 19) was 5,700.

REFERENTIAL EXAMPLE 20

In 500 g of water was dissolved 12 g of the polymer (Sample 16) obtained in Referential Example 16, and the solution was poured onto 500 g of a strong acidic cation exchange resin, after which the resulting mixture was allowed to stand for 24 hours. Said resin was removed by filtration, and the filtrate was evaporated to dryness. The solid product obtained amounted to 11.5 g (hereinafter referred to as Sample 20). In the neutralization analysis of the Sample 20, it was neutralized with an equivalent of NaOH. These results indicate that the polymer (Sample 20) obtained by the cation exchange treatment has a structure of the formula (e) wherein M=H, and after the neutralization it was converted to M=Na.

REFERENTIAL EXAMPLE 21

When the Sample 20 obtained in Referential Example 20 was neutralized with KOH, $Ca(OH)_2$, ammonia or monoethanolamine, each reaction was completed with an equivalent of the base. Water was removed under reduced pressure, to separate each polymer. The polymer obtained is in the form of a K salt (Sample 21), a Ca salt (Sample 22), an ammonium salt (Sample 23) or a monoethanolamine salt (Sample 24).

REFERENTIAL EXAMPLE 22

The same procedure as in Referential Example 17 was repeated except that the polymerization time was varied to 20 hours. The weight average molecular weight of the polymer obtained (Sample 25) was 19,000, and the surface tension of 4% aqueous solution of the polymer was 72.6 dyn/cm.

EXAMPLES 47-58 AND COMPARATIVE EXAMPLES 7-10

(Preparation of pitch)

Three kinds of pitches different in softening point L (softening point: 67°-72° C.), M (softening point: 82°-85° C.) and N (softening point: 120° C.) were individually pulverized in a sample mill by a dry method to obtain fine pitch powders.

The particle sizes of the fine pitch powders are shown in Table 5.

TABLE 5

| | Pitch | | |
|---|---|---|---|
| | L | M | N |
| 200 mesh (Tyler) passing (%) | — | 73.1 | 76.2 |
| Average Particle Diameter | 44 | 42 | 39 |

(Preparation of pitch-water slurry)

One of the dispersing agenets obtained in Referential Examples 16-22 (Samples 16-25) or a conventional dispersing agent was added to water, and a pitch as shown in Table 6 was also added to water in the prescribed amount, after which the resulting mixture was stirred in a homomixer at 3,000 rpm for 15 minutes to obtain a pitch-water slurry having the desired concentration. The viscosity of the pitch-water slurry thus obtained was measured at 25° C. Also, the slurry was further allowed to stand, and the viscosity was measured with the lapse of time to observe the stability.

The results obtained are shown in Table 6.

From the data in Table 6, it can be seen that the dispersing agent of this invention is excellent in dispersibility and stability of slurry. Also, no foaming of a slurry was observed.

TABLE 6

| No. | Dispersing agent | Amount of dispersing agent (% based on slurry) | Concentration of slurry (%) | Viscosity of slurry (cp) | Viscosity of slurry after 10 days (cp) | Kind of pitch |
|---|---|---|---|---|---|---|
| Example 47 | Sample 16 | 0.5 | 66 | 560 | 580 | N |
| Example 48 | Sample 17 | 0.5 | 66 | 520 | 530 | N |
| Example 49 | Sample 18 | 0.5 | 66 | 610 | 600 | L |
| Example 50 | Sample 20 | 0.5 | 66 | 700 | 690 | N |
| Example 51 | Sample 21 | 0.5 | 66 | 500 | 530 | N |
| Example 52 | Sample 22 | 0.5 | 66 | 560 | 580 | N |
| Example 53 | Sample 23 | 0.5 | 66 | 540 | 550 | N |
| Example 54 | Sample 24 | 0.5 | 66 | 590 | 580 | L |
| Example 55 | Sample 25 | 0.5 | 66 | 510 | 530 | M |
| Example 56 | Sample 19 | 0.5 | 66 | 500 | 530 | M |
| Example 57 | Sample 16 | 0.5 | 70 | 980 | 960 | N |
| Example 58 | Sample 16 | 0.3 | 66 | 690 | 720 | N |
| Comparative Example 7 | High-condensate of naphthalene-sulfonic acid | 0.5 | 66 | 970 | Caking | N |
| Comparative Example 8 | Low-condensate of naphthalene-sulfonic acid | 0.5 | 66 | 1320 | Caking | N |
| Comparative Example 9 | Polyoxyethylene-nonylphenyl ether (HLB 18.1) | 0.5 | 66 | 1300 | 1480 | N |
| Comparative Example 10 | Polyvinyl alcohol | 0.5 | 66 | 1690 | 1880 | N |

We claim:

1. A slurry composition, comprising:

(a) from 50 to 90% by weight of a powdered solid fuel in said slurry, (2) water, and (3) from 0.01 to 10% by weight of a dispersing agent consisting of a compound or polymer having in its molecular structure a tricyclodecane or tricyclodecene skeleton and a sulfonic acid group attached to the skeleton.

2. The slurry composition according to claim 1, wherein the solid fuel powder is pulverized coal, petroleum coke or pitch.

3. The slurry composition according to claim 1 or 2, wherein the dispersing agent is (1) a sulfonation product of a polymer of a compound represented by formula (A)

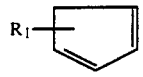

or formula (B)

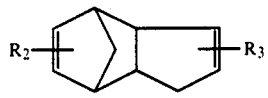

wherein $R_1$, $R_2$ and $R_3$ are independently hydrogen atoms or alkyl groups having 1 to 3 carbon atoms; or a copolymer of compounds represented by formula (A) or (B); or (2) a sulfonation product of a reaction product of a compound represented by formula (C)

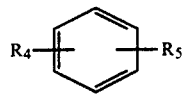

in which $R_4$ and $R_5$ are independently hydrogen atoms or alkyl groups having 1 to 3 carbon atoms with a compound represented by formula (A) or (B) or a reaction product of a compound represented by formula (C) with a compound represented by formula (A) and a compound represented by formula (B), or a condensate of the sulfonation product (2).

4. The slurry composition according to claim 1 or 2, wherein the dispersing agent is a compound represented by the formula:

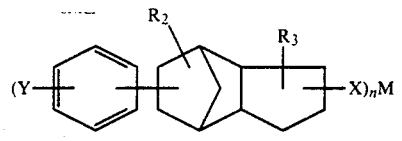

(D)

wherein $R_2$ and $R_3$ are independently hydrogen atoms or alkyl groups having 1 to 3 carbon atoms; X and Y are hydrogen, alkyl or $—SO_3$, at least one of X and Y being $—SO_3$; n is 1 or 2; and M is hydrogen, an alkali metal, an alkaline earth metal, an ammonium group or a hydrocarbylammonium group, or a condensate of said compound.

5. The slurry composition according to claim 1 or 2, wherein the dispersing agent is a polymer or copolymer of a compound represented by the formula:

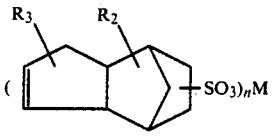

(E)

wherein $R_2$, $R_3$, n and M are the same as defined in claim 4, or a polymer or copolymer of a compound represented by the formula:

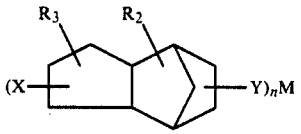

(F)

wherein $R_2$, $R_3$, X, Y, M and n are the same as defined in claim 4.

6. The slurry composition according to claim 1 or 2, wherein the dispersing agent is at least one member selected from the group consisting of:

(1) a sulfonation product of a polymer or a copolymer or a mixture thereof obtained by polymerizing cyclopentadiene or its derivative or derivatives represented by the formula:

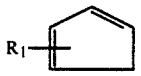

(a)

wherein $R_1$ is a hydrogen atom or an alkyl group having 1–3 carbon atoms, or cyclopentadiene or its derivative or derivatives represented by the formula:

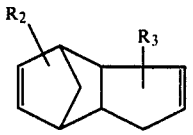

(b)

wherein $R_2$ and $R_3$, which may be the same or different, are hydrogen atoms or alkyl groups having 1–3 carbon atoms;

(2) a sulfonation product obtained by sulfonating a reaction product mixture which is obtained by reacting cyclopentadiene or its derivative or derivatives represented by the formula (a) or dicyclopentadiene or its derivative or derivatives represented by the formula (b) with a compound represented by the formula:

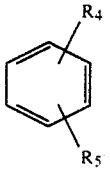

(c)

wherein $R_4$ and $R_5$, which may be the same or different, are hydrogen atoms or alkyl groups having 1–6 carbon atoms, or a condensate of said sulfonation product;

(3) a condensate obtained by condensing a sulfonated cyclopentadiene derivative represented by the formula:

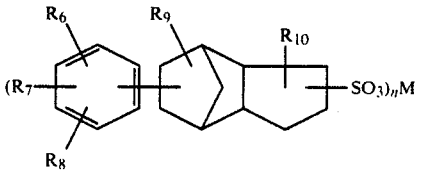

(d)

wherein $R_6$, $R_7$ and $R_8$, which may be the same or different, are hydrogen atoms or alkyl groups having 1–6 carbon atoms, $R_9$ and $R_{10}$, which may be the same or different, are hydrogen atoms or alkyl groups having 1–3 carbon atoms, n is 1 or 2, and M is a hydrogen atom, an alkali metal, an alkaline earth metal, an ammonium group or a hydrocarbylammonium group;

(4) a polymer or copolymer of a sulfonated dicyclopentadiene represented by the formula:

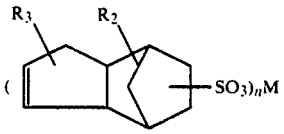

(e)

wherein $R_2$, $R_3$, n and M are the same as defined above;

(5) a polymer or copolymer of a sulfonated hydroxydicyclopentadiene represented by the formula:

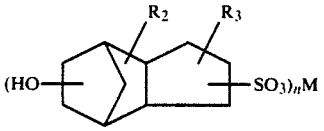

(f)

wherein $R_2$, $R_3$, n and M are the same as defined above; and (6) a condensate obtained by the condensation of a disulfonation product of a dicyclopentadiene derivative represented by the formula:

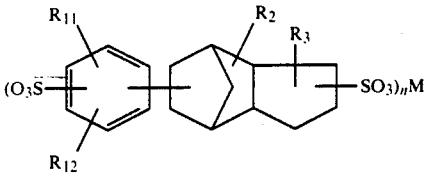

(g)

wherein $R_{11}$ and $R_{12}$, which may be the same or different, are hydrogen atoms or alkyl groups having 1–2 carbon atoms, and $R_2$, $R_3$, M and n are the same as defined above.

7. The slurry composition according to claim 1, wherein the dispersing agent is a polymer or a copolymer of a sulfonated dicyclopentadiene represented by the formula:

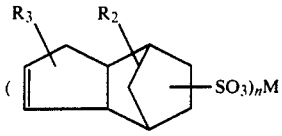

(e)

wherein $R_2$ and $R_3$ are independently hydrogen atoms or alkyl groups having 1 to 3 carbon atoms; M is a hydrogen atom, an alkali metal, an alkaline earth metal, an ammonium group or a hydrocarbylammonium group; and n is 1 or 2.

8. The slurry composition according to claim 1, wherein the solid fuel content in the slurry is 60 to 85% by weight.

9. The slurry composition according to claim 1, wherein the dispersing agent content in the slurry is 0.05 to 1% by weight.

* * * * *